US005700195A

United States Patent [19]

Halic

[11] Patent Number: 5,700,195

[45] Date of Patent: Dec. 23, 1997

[54] SLOT MACHINES HAVING SECURITY FOR BILL VALIDATOR AND BILL STACKER

[75] Inventor: Vladimir Halic, Wollongong, Australia

[73] Assignee: Aristocrat Leisure Industries, Sydney, Australia

[21] Appl. No.: 626,816

[22] Filed: Apr. 3, 1996

[51] Int. Cl.[6] ..... G07F 17/34; G07F 7/04

[52] U.S. Cl. ..... 463/29; 463/20; 273/143 R; 194/350; 194/206

[58] Field of Search ..... 273/143 R, 138.1, 273/138.2; 463/20, 29, 25; 194/206, 350

[56] References Cited

U.S. PATENT DOCUMENTS 4,326,620 4/1982 Felix et al. ..... 194/1 A 5,515,959 5/1996 Stephenson, III et al. ..... 194/206

5,544,728 8/1996 Dabrowski ..... 194/206

*Primary Examiner*—Benjamin H. Layno

*Attorney, Agent, or Firm*—Anderson Kill & Olick, P.C.

[57] ABSTRACT

A slot machine comprising a cabinet, a first lockable door giving access to the interior of the cabinet, a second lockable door hingedly mounted in the first, a bill validator associated with a bill stacker arranged within the cabinet and supported in a housing, the housing have a lockable means controlling removal of the bill stacker from the housing, the said lockable means being accessible only through said second lockable door, the bill validator being accessible only through first lockable door for servicing or replacement.

3 Claims, 7 Drawing Sheets

SLOT MACHINES HAVING SECURITY FOR BILL VALIDATOR AND BILL STACKER

The present invention relates to slot machines and more particularly to a slot machine including means for accommodating a currency note validator and stacker.

In some parts of the world it is becoming more common to see a currency note validator, commonly known as a "bill changer" attached to the side of a slot machine (otherwise known as a poker or fruit machine). These bill changers are sophisticated devices made by specialist companies, and allow the player to obtain game credits by bills as well as playing by coin through the conventional coin slot of the machine.

DESCRIPTION OF THE PRIOR ART

With advanced technology the bill validator has been reduced in size to the point where it can be fitted within the slot machine itself, however the problems of security —whilst enabling ready access to remove accumulated bills and for easy servicing, have to be addressed in its new locations.

It is desirable, almost essential, that the accumulated bills can be removed from the machine without giving access to the interior, so that access to coins or the chances of cheating or collusion are greatly reduced. Coins are readily handled in this way as the machine is not opened to clear it. Also each time the machine's door is opened by a serviceman, this fact is automatically recorded.

It is also necessary to provide access to a validator by a serviceman for repair or replacement of the validator but without giving the serviceman access to the bill stacker in which bills inserted in the machine are stored.

SUMMARY OF THE INVENTION

The present invention provides a slot machine in which a bill validator and bill stacker are installed which meets the requirements set out above.

The present invention consists in a slot machine comprising a cabinet, a first lockable door giving access to the interior of the cabinet, a second lockable door hingedly mounted in the first, a bill validator associated with a bill stacker arranged within the cabinet and supported in a housing, the housing having a lockable means controlling removal of the bill stacker from the housing, the said lockable means being accessible only through said second lockable door, the bill validator being accessible only through first lockable door for servicing or replacement.

It is preferred that the bill stacker is carried in an inner liner of the housing that is pivotable in relation thereto, the bill stacker being maintained in a close functional relationship with the bill validator by spring means, the said lockable means being a drop down lockable door on the housing giving access to the bill stacker, the said dropped down door being connected to by link means to the inner liner whereby, on opening of the drop down door, the inner liner is caused to pivot in related to the housing to move the bill stacker away from close contact with the validator and permit its removal.

It is further preferred that the housing is pivotably mounted to facilitate servicing or replacement of the validator.

BRIEF DESCRIPTION OF THE DRAWINGS

In order that the nature of the invention may be better understood a preferred embodiment is hereinafter described by way of example with reference to the accompanying drawings in which.

DETAILED DESCRIPTION OF THE PREFERRED EMBODIMENTS

Figure 1:
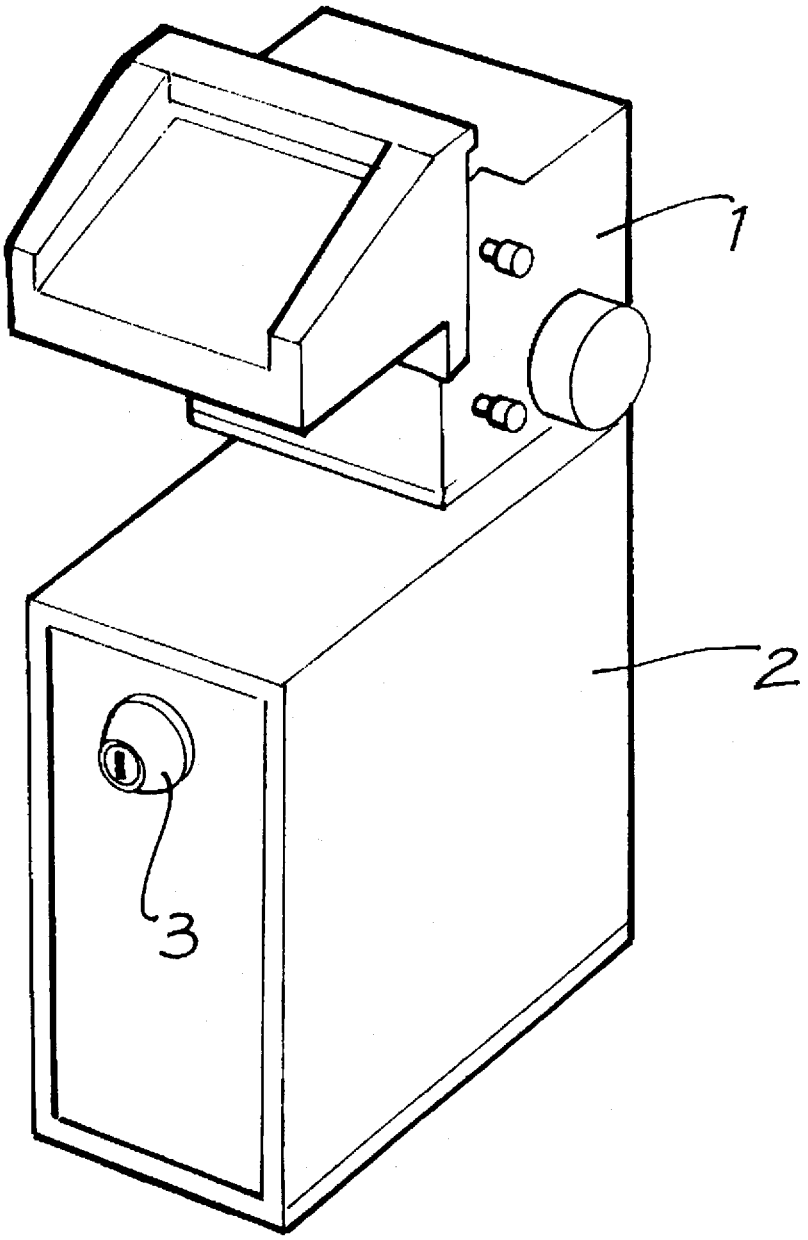
FIG. 1 is a perspective view of a bill validator associated with a bill stacker.

FIG. 1 shows a typical bill validator 1 arranged on top of a bill stacker 2. These are standard articles of commerce and are bought in by the slot machine manufacturer ready for installation. Bills are inserted in a receiving tray on top of the validator and after being validated are pressed down through a slot in the top of the stacker 2 for storage therein.

Figure 2:
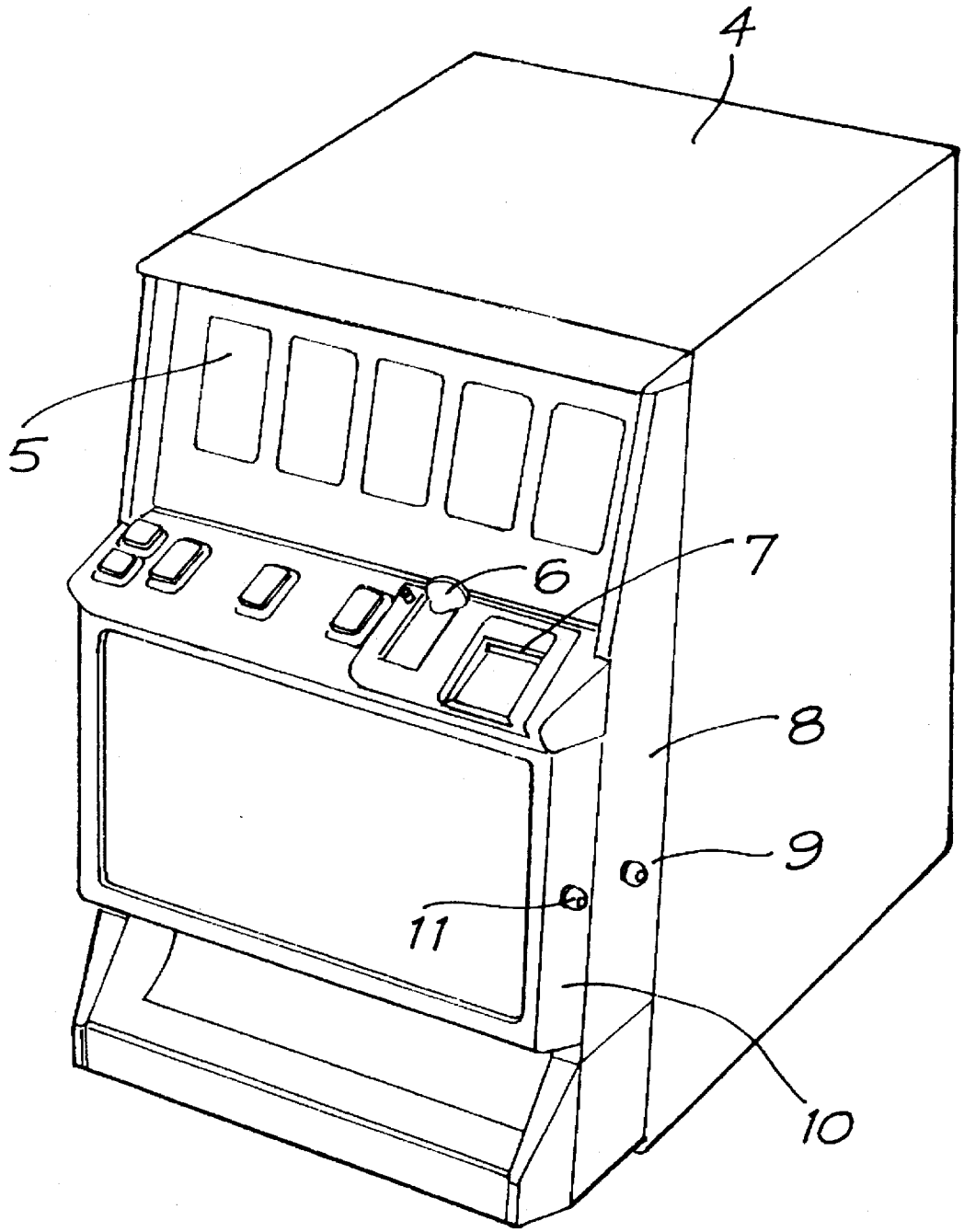
FIG. 2 is a perspective view of a slot machine incorporating the invention.
Figure 3:
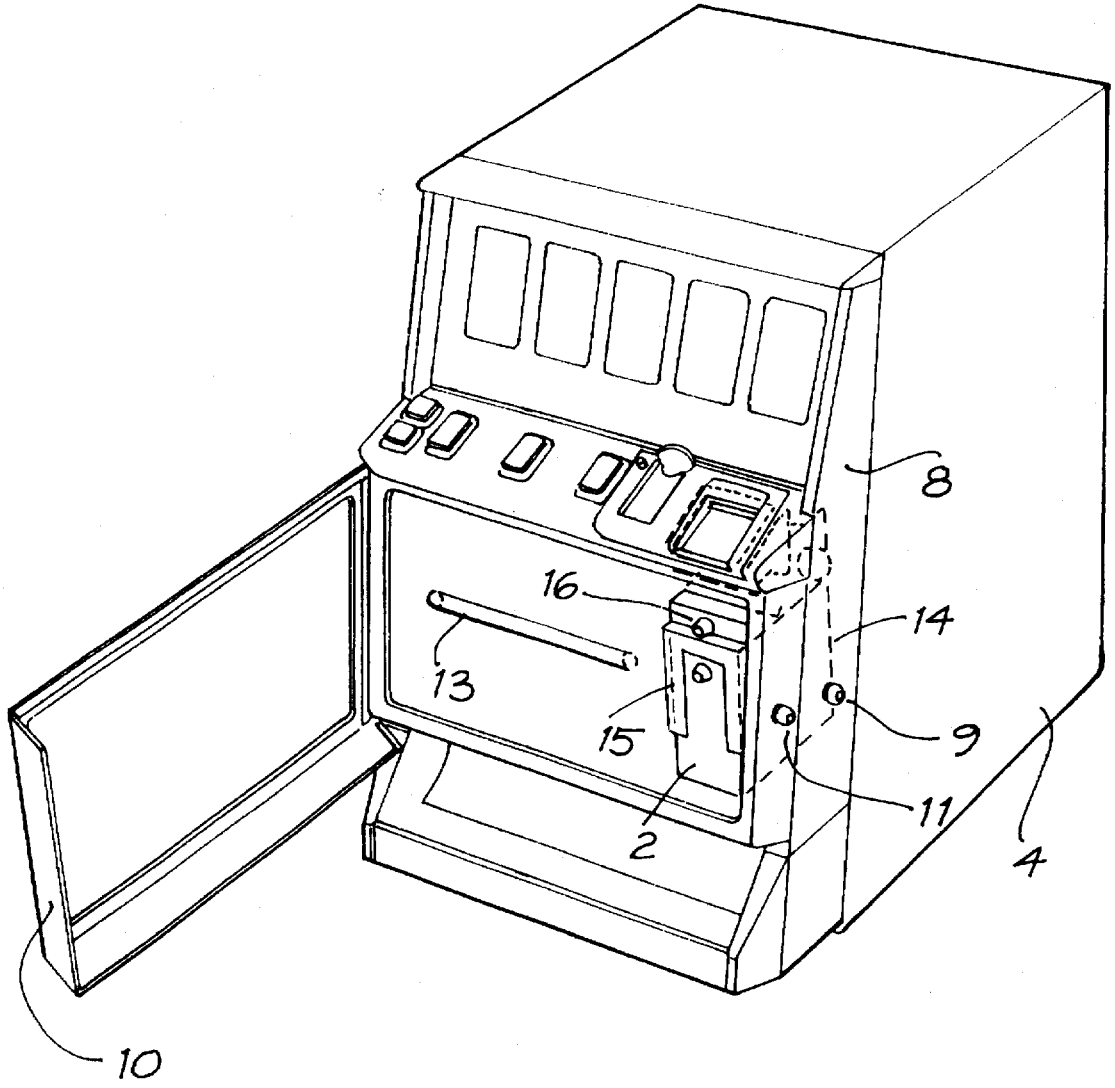
FIG. 3 is a perspective view of a slot machine of FIG. 2 where the second lockable door is open.
Figure 4:
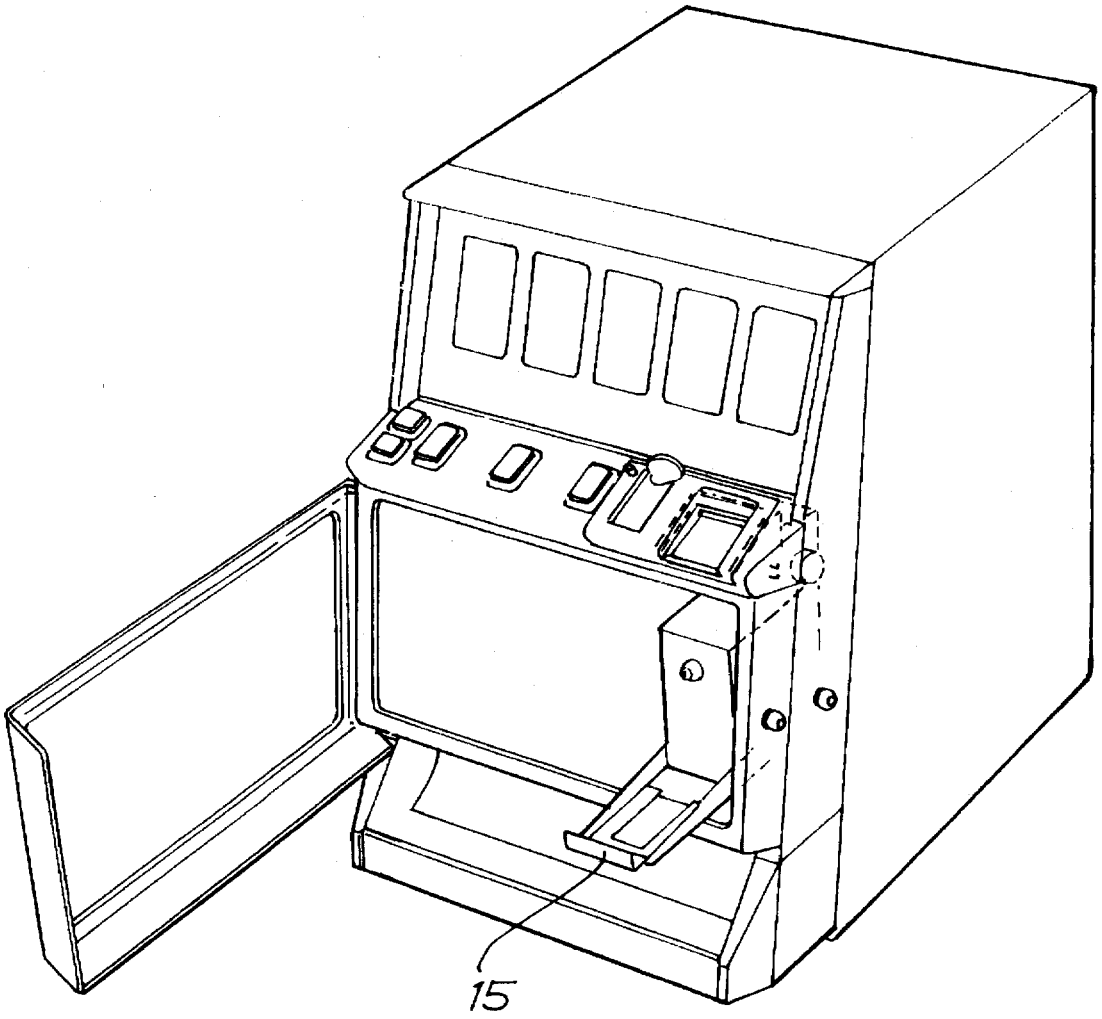
FIG. 4 is a view similar to FIG. 3 with the drop down lockable door securing the bill stacker, open.

The slot machine shown in FIG. 2 has a casing 4 having the usual window 5, a coin slot 6 and a bill receiving slot 7. The casing 4 has a main or first lockable door 8 which is secured by means of the lock 9. Hinged from the first door 8 is a second lockable door 10 secured by the lock 11. The second lockable door 10 normally carries on its face a prize schedule which can be readily changed if the machine is to have its combination or game changed. It is illuminated by a fluorescent lamp 13 which is readily accessible for replacement. The opening of the second door 10 reveals the stacker 2 on which is mounted the validator 1 in the position shown in FIG. 1. Access to the stacker is secured by the drop down door 15 which can be lowered to a position shown in FIG. 4 after unlocking the lock 16.

The bill stacker 2 is contained within a casing 14 which is mounted for pivoting about the pivot 17. The coin validator is shown in chain lines and is mounted on top of the stacker and is held in position by means of pins 23 engaging slots 24 in an upward extension of the casing 14. The casing 14 is secured to the main structure of the slot machine by a screw (not shown) passing through holes indicated at 18.

Figure 7:
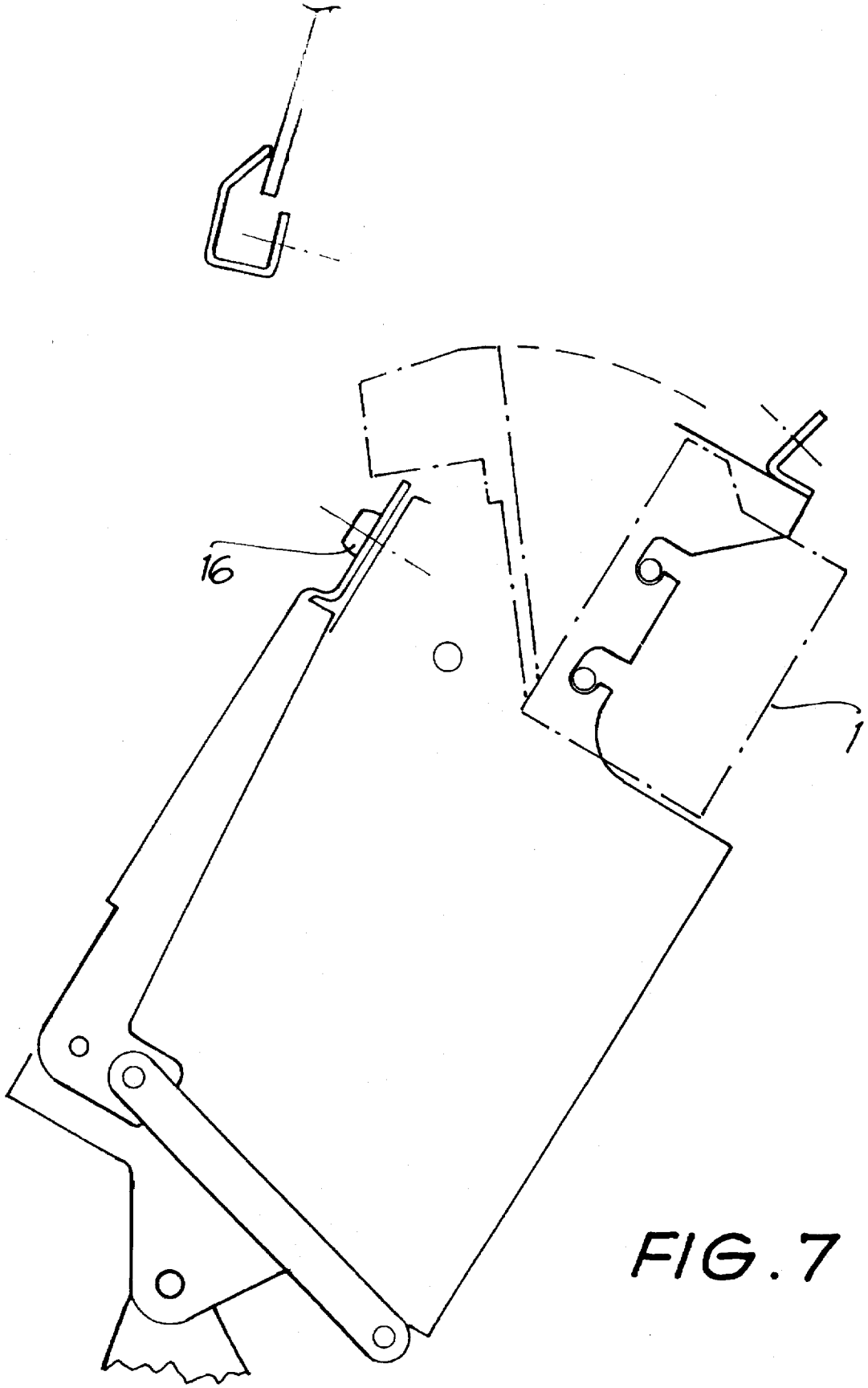
FIG. 7 is a similar view to FIG. 5 showing the coin casing together with the stacker and coin validator tilted rearwardly to permit servicing or removal of the bill validator.

If the validator 1 is to be serviced, a serviceman gains access to the interior of the machine by unlocking the lock 9 and opening the first door 8. On removal of the screw securing the casing 14 to the structure of the slot machine, the whole casing may be pivoted backwards about the pivot 17 as shown in FIG. 7. In this position the validator 1 may be removed and serviced or replaced.

It will be noted however that the bill stacker 2 cannot be removed from the casing 14 by reason of the fact that the drop down door 15 is still in position and secured by the lock 16.

The serviceman will have no access to the drop down door 15 because he will not have a key to the lock 15.

Figure 5:
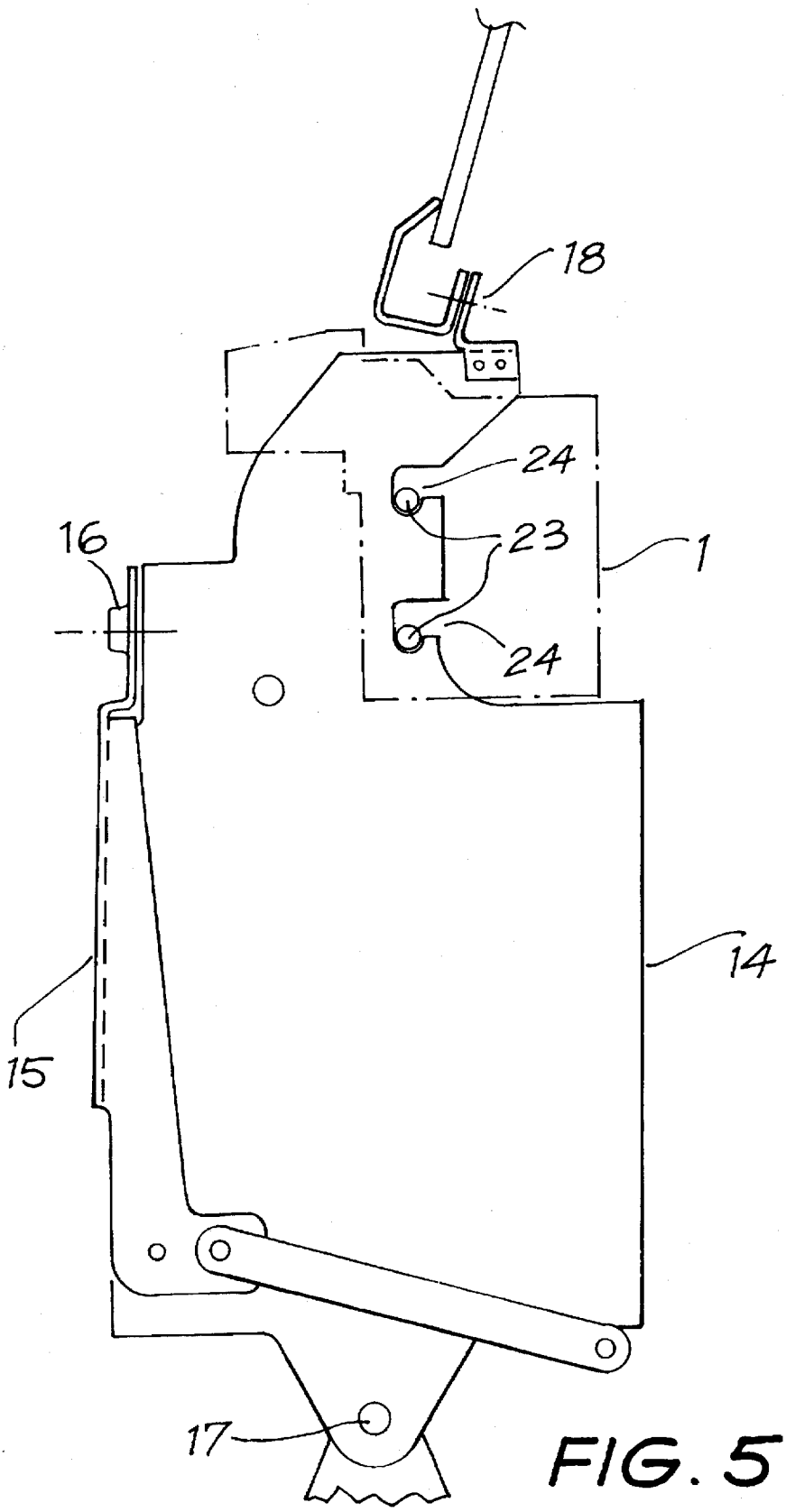
FIG. 5 is a side elevation of a bill stacker in association with a bill validator with the drop down door closed.
Figure 6:
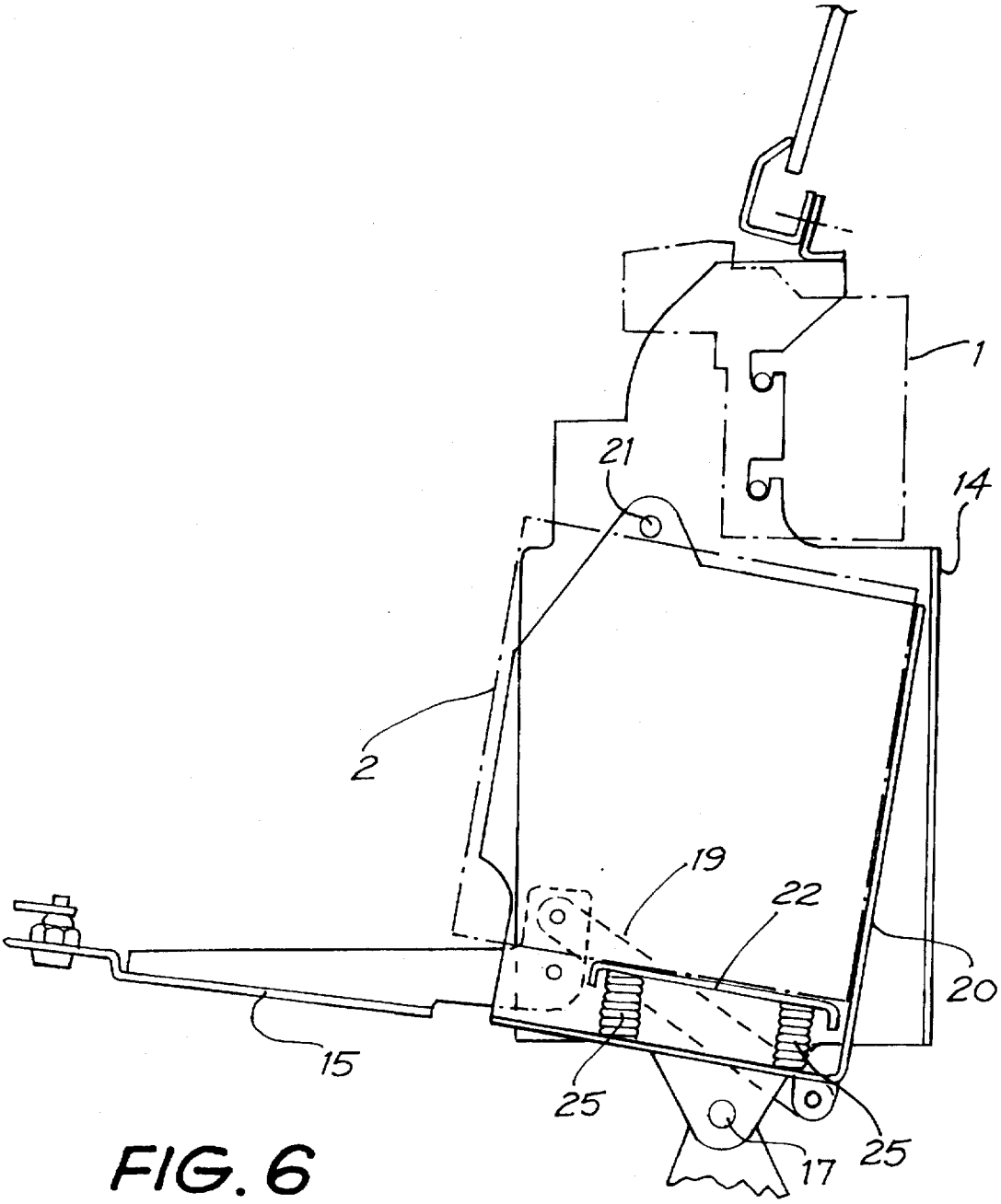
FIG. 6 is a similar view with the drop down door open.

When a person authorized to remove the bill stacker from the machine is required to do so, he will open the second door 10 by unlocking the lock 11. He however will not have a key to the lock 9 and will therefore be denied access to the interior of the machine. On opening the second door 10 access is given to drop down door 15 which is released by operating the lock 16. On hinging the door 15 downwardly the cranked end of the door 15 acts through the link 19 to tilt an inner liner 20 forwardly causing it to pivot about the pivot point 21. When this is down the upper surface of the bill stacker 2 is brought out of contact with the bottom of the validator 1 and the bill stacker 2 may be readily removed. When this is replaced by a fresh bill stacker this is inserted into the inner liner 20 and the drop down door 15 closed. The act of closing the door brings the inner container back to the position shown in FIG. 5 and also presses the upper surface of the bill stacker 2 against the bottom of the coin validator 1. This applies pressure to the plate 22 causing it to compress the springs 25. The result of this is that when the bill stacker 2 is in the position shown in FIG. 5 the springs 25 will press it up against the bill validator 1 ensuring that these are in intimate contact and that bills will be passed properly from the bill validator 1 to the bill stacker 2. Once the drop down door 15 has been hinged upwardly the lock 16 is locked and the second door 10 closed and locked.

The apparatus described achieves the object of the invention in that, whereas an authorized person has access to and can remove a bill stacker he has no access to the interior of the machine and a serviceman requiring to service the bill validator has no access to the bill stacker.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrated and not restrictive.

I claim:

1. A slot machine comprising a cabinet, a first lockable door giving access to the interior of the cabinet, a second lockable door hingedly mounted in the first, a bill validator associated with a bill stacker arranged within the cabinet and supported in a housing, the housing having a lockable means controlling removal of the bill stacker from the housing, the said lockable means being accessible only through said second lockable door, the bill validator being accessible only through first lockable door for servicing or replacement.

2. A slot machine as claimed in claim 1 wherein the bill stacker is carried in an inner liner of the housing that is pivotable relation thereto, the bill stacker being maintained in a close functional relationship with the bill validator by spring means, the said lockable means being a drop down lockable door on the housing giving access to the bill stacker, the said dropped down door being connected to by link means to the inner linear whereby, an opening of the drop down door, the inner liner is caused to pivot in relation to the housing to move the bill stacker away from close contact with the validator and permit its removal.

3. A slot machine as claimed in claim 1 wherein the housing is pivotably mounted to facilitate servicing or replacement of the validator.

* * * * *

UNITED STATES PATENT AND TRADEMARK OFFICE

CERTIFICATE OF CORRECTION

PATENT NO. : 5,700,195
DATED : December 23, 1997
INVENTOR(S) : Vladimir Halic

It is certified that error appears in the above-identified patent and that said Letters Patent is hereby corrected as shown below:

Title page, item [73], Assignee: should read--Aristocrat Leisure Industries PTY Ltd., Sydney, Australia--.

Signed and Sealed this

Tenth Day of March, 1998

*Attest:*

*Attesting Officer*

BRUCE LEHMAN

*Commissioner of Patents and Trademarks*